United States Patent [19]

Nilsson

[11] Patent Number: 4,534,498

[45] Date of Patent: Aug. 13, 1985

[54] GUIDING AND BRAKING UNIT FOR A MATERIAL WEB

[75] Inventor: Thorsten Nilsson, Landskrona, Sweden

[73] Assignee: Tetra Pak International AB, Lund, Sweden

[21] Appl. No.: 491,041

[22] Filed: May 3, 1983

[30] Foreign Application Priority Data

May 6, 1982 [SE] Sweden ..... 8202829

[51] Int. Cl.[3] ..... B65H 17/22; B65H 23/08

[52] U.S. Cl. ..... 226/181; 226/183; 226/190; 226/195

[58] Field of Search ..... 226/168, 181–183, 226/186, 187, 192, 194, 15, 21, 174; 400/618, 619, 607.01

[56] References Cited

U.S. PATENT DOCUMENTS

| | | | |
|---|---|---|---|
| 3,596,817 | 8/1971 | Morse et al. | 226/21 |
| 3,602,448 | 2/1970 | Muensterer | 242/55 |
| 3,750,924 | 8/1973 | Pepper | 226/174 |
| 3,964,739 | 6/1976 | Garcia | 271/3 |
| 4,284,222 | 8/1981 | Hank | 226/181 |

FOREIGN PATENT DOCUMENTS

| | | |
|---|---|---|
| 970793 | 9/1964 | United Kingdom . |
| 1154253 | 6/1969 | United Kingdom . |

*Primary Examiner*—Leonard D. Christian

*Attorney, Agent, or Firm*—Burns, Doane, Swecker & Mathis

[57] ABSTRACT

A guiding and braking unit for a material web which passes through a processing machine, such as a machine for the manufacture of packing containers. The unit comprises a roller adapted to a guide cylinder for the web. This roller is manufactured from a material with a high coefficient of friction. The roller is adapted so that it can be swivelled via an arm in a direction transverse to that of the material web to thus follow the material web when it is moved sideways, or axially in relation to the guide cylinder. Each sideways movement, however, because of the suspension of the roller, brings about a lifting of the roller which is continuously counteracted by the pressing of the roller against the cylinder. As a result, the roller is returned automatically to a central position and through friction, carries the material web with it to a central position in relation to the guide cylinder.

7 Claims, 2 Drawing Figures

GUIDING AND BRAKING UNIT FOR A MATERIAL WEB

BACKGROUND AND SUMMARY OF THE INVENTION

The present invention relates to a guiding and braking unit comprising a guide cylinder and a rotating roller resting against the cylinder.

In machines for the processing of different types of material webs the material web in general is guided through the machine between a number of processing stations with the help of different types of guiding elements. When the material web is to change direction, guide rollers are used over which the web moves with a larger or smaller enclosed angle. The guide rollers may be suspended in the frame of the machine so that they can freely rotate or they may be connected to a driving element such as an electric motor. To prevent the material web from wandering sideways when it passes over the guide cylinder, owing to inaccuracies in the web itself or in the elements guiding it, lateral guides may be placed before or after the guide cylinder. It is also customary to provide the guide cylinder with guide flanges which are at a mutual distance corresponding to the width of the material web.

Both these methods make it necessary for the guides or guide flanges to be reset or substituted when a material web of another web width is to be processed in the machine. The arrangements are also sensitive to small, otherwise permissible, variations in the width of the material web. In the case of material webs of the "semi-rigid" type, such as the packing laminates of paper and plastics which are used in the manufacture of packing containers for liquid contents, the guide elements sometimes cause damage through wear and buckling along the edges of the web.

Moreover, it is generally important in packing machines that the material web, while being fed through the machine, should be kept relatively well stretched. This is achieved in general by means of braking devices resting directly or indirectly against the web such as braked guide cylinders.

It is an object of the present invention to provide a combined guiding and braking unit which can replace earlier separate arrangements for guiding and braking without being subject to the same disadvantages.

It is a further object of the present invention to provide a guiding and braking unit which has a simple and reliable design and which is economical in its manufacture and can be used in many types of machines for the processing of webs.

It is a further object of the present invention to provide a guiding and braking unit which, without adjustment, can be used for different web widths and which, moreover, requires minimum maintenance.

These and other objects have been achieved in the invention by a a guiding and braking unit comprising a guide cylinder and a rotating roller resting against the cylinder. The roller is adapted to swivel in a plane parallel with the center axis of the cylinder and rest against the cylinder within an angle of 2°–60° degrees from a radius of the cylinder extending perpendicularly to the said plane.

The design of the invention makes possible a combined guiding and braking unit which, even during prolonged operation, effectively retains a material web in the desired axial position in relation to a guide cylinder. The unit is completely cylindrical and lacks flanges or other elements to guide the web. The unit is self-adjusting and does not require to be reset after alterations of the width of the material web.

BRIEF DESCRIPTION OF THE DRAWINGS

A preferred embodiment of the unit will be described in the following with special reference to the enclosed schematic drawing which only shows the details required for an understanding of the invention.

DETAILED DESCRIPTION OF THE PREFERRED EMBODIMENTS

Figure 2:
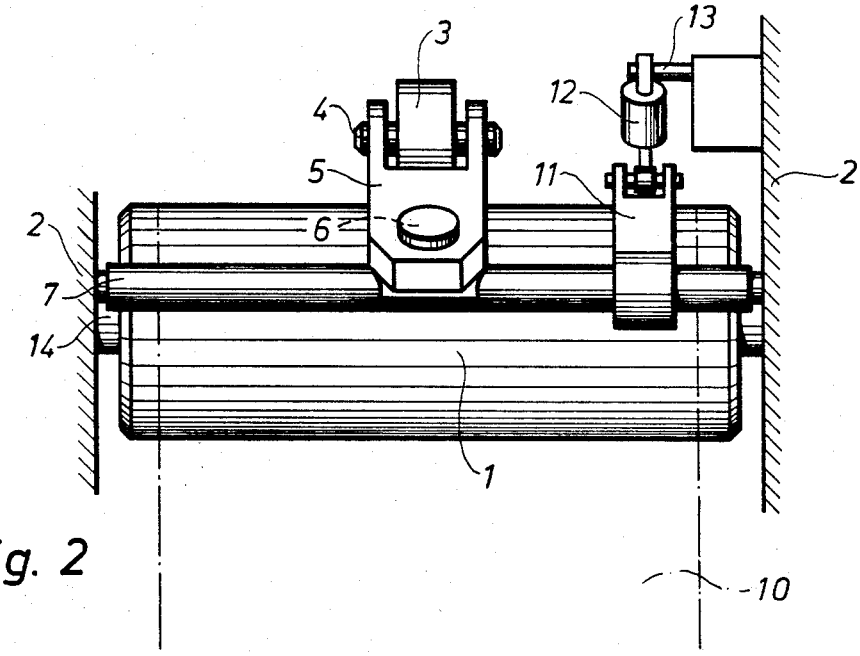
FIG. 2 is a view which shows the guiding and braking unit of FIG. 1 in perspective.

The guiding and braking unit of the invention comprises a cylindrical guide cylinder 1 which is supported so that it can rotate in the frame 2 of the actual machine (FIG. 2). The guide cylinder may be freely rotating or driven with a motor. The guide cylinder is preferably manufactured from stainless steel or rigid plastics.

Against the guide cylinder rests a rotating roller 3 which is supported so that it can freely rotate around a center axis 4 in a fork-shaped arm 5. The diameter of the roller 3, as well as its length, are appreciably smaller than the corresponding dimensions of the guide cylinder 1.

Figure 1:
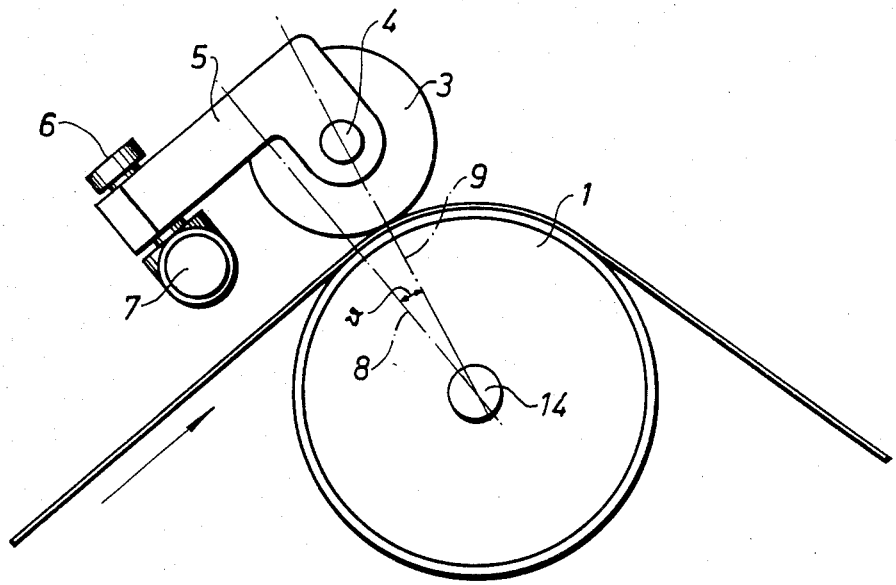
FIG. 1 is a view which shows a guiding and braking unit from the side.

The arm 5 is suspended at an end opposite roller 3 so that the arm can be swivelled around axis 6. The swivelling axis extends at right angles to the center axis 14 of the cylinder 1 and makes it possible to swivel the roller 3 in a plane parallel with the said center axis 14. The swivelling axis 6 of the arm 5 is connected via a further axis 7 to the frame of the machine 2. By swivelling the arm 5 around the second swivelling axis 7, the roller 3 is movable between an active position resting against the cylinder 1 (FIG. 1) and a passive, swivelled-out position. Where the roller 3 is at some distance from the surface of the cylinder 1. In its active position, the roller 3 rests against the surface of the roller 1 within an angle v of 2°–60° from a radius 8 of the cylinder 1 extending perpendicularly to the said swivelling plane. In the preferred embodiment, the angle v between the said radius and a center line 9 connecting the center axes 14 and 4 of the cylinder 1 and the roller 3, respectively, is approximately 10° behind the said radius 8 when viewed in the direction of rotation of the cylinder.

In the preferred design shown an angle of 5°–15° has proved to give adequate results. In modified designs satisfactory results could be obtained within limits as wide as 2°–60°. However, the value of 10° chosen in the design shown provides both operation, and also a compact, easily maneuvered unit.

In a preferred embodiment of the apparatus, the arm 5 is dimensioned and placed so that the swivelling axis 6 and the center axis 4 of the roller 3 will be located on either side of the extension of the said radius 8. It has been found that this design produces the best effect. It is also possible to place the swivelling axis 6 past the radius 8 viewed in the direction of rotation of the cylinder 1. The arm 5, moreover, should extend substantially parallel with the incoming portion of a material web 10 moving over the guide roller 1, which means that the swivelling axis 6 of the arm 5 will extend substantially perpendicularly to the incoming web portion 10.

As mentioned previously, the roller 3 is movable between an active position, resting against the cylinder, and a passive, swivelled-out position. The movement is achieved by the arm 5 being made to swivel in a direction to and from the cylinder around the swivelling axis 7. It is evident from FIG. 2 how the swivelling axis 7 is connected via an arm 11 to a compressive force generating device 12 in the form of a pneumatic cylinder, the opposite end of which is connected to an axle 13 projecting from the machine frame 2. The compressive force generating device 12 serves partly for moving the roller 3 between the said active and passive positions and partly for pressing the roller under a predetermined pressure against the cylinder 1.

The roller 3 is preferably cylindrical and manufactured from a material with a high coefficient of friction such as rubber or plastics. In case of high demands on the braking effect of the unit, moreover, the roller 3 should be made of a flexible material, since the braking effect is achieved primarily by the effort used in deforming the roller 3 when it is pressed against the surface of the cylinder 1 by the compressive force generating device 12.

During operation of the processing machine, material web 10 is fed over the guide cylinder 1. The roller 3 is moved to its active position resting against the cylinder. The material web 10 passes between the cylinder 1 and the roller 3. The material web is either advanced by some device not shown in the drawing or driven with the help of the guide cylinder 1 and a driving motor coupled to the same. The web material in turn drives the roller 3 so that the latter rotates around the axis 4 at a speed corresponding to the speed of motion of the material web 10. At the same time the pressure of the roller 3 against the material web passing over the cylinder 1 causes a deformation of the part of the roller 1 in contact with the material web. The size of the deformation depends on the force with which the compressive force generating device 12 presses the roller 3 against the material web, and also on the flexibility of the material from which the roller 3 is manufactured. For guide cylinders of the freely rotating type, that is to say non-driven type, the stretching of the part of the material web 10 which runs off the guide cylinder is ensured by a braking effect caused by the deformation of the roller 3. It is appropriate, therefore, in the case of non-driven guide cylinders 1 to choose a relatively soft and flexible material for the roller 3, or to press the roller relatively strongly against the material web with the help of the compressive force generating device.

The material from which the roller 3 is manufactured, as mentioned previously, should also have a relatively high coefficient of friction, which in any case is appreciably higher than the coefficient of friction of the cylinder 1. If the roller 3 is manufactured from a flexible rubber material, the friction between the roller and the material web 10 will be appreciably higher than the friction between the material web 10 and the cylinder because the cylinder is usually made of stainless steel or some other inflexible material.

The high friction between the roller 3 and the material web 10 has the effect that if the material web 10, if for any reason whatever it is moved sideways, that is to say in axial direction of the guide cylinder during its feed over the guide cylinder 1, then the material web will carry the roller 3 with it so that the roller via the arm 5 swivels around the axis 6 on arm 5. Owing to the geometry of its suspension, each swivelling of the roller 3 sideways around the axis 6 means that the roller has to "climb up" the surface of the cylinder 1 (or more correctly the surface of the material web resting against the cylinder) and is thus lifted against the effect of the compressive force generating device 12. In so doing the arm 5 also swivels around the second axis 7. However, the compressive force generating device constantly endeavours to move the roller in the direction toward the center 14 of the cylinder 1. Thus the roller 3 is immediately forced back into the position shown in FIG. 2 where the axis extends parallel with the center axis 14 of the cylinder 1. On account of the high friction between the surface of the roller and the material web 10, the return movement of the roller 3 causes a sideways directed force which moves the material web 10 back again to its originally chosen central position in relation to the guide cylinder 1. In this manner each movement of the material web 10 in sideways direction in relation to the cylinder 1 will bring about a turning and lifting of the roller 3. The movement immediately causes a counter force in the compressive force generating device which endeavours to lead the roller 3 back to its original position. Thus, roller 3 guides the material web so that it successively wanders sideways over the surface of the guide cylinder back to the centered position.

When required, the roller 3 may be lifted from its active to its passive position with the help of the compressive force generating device. The supply of pressure fluid to the compressive force generating device 12 also can be varied depending on the contact pressure desired between the roller 3 and the cylinder 1. In general, higher contact pressure gives higher braking effect and stronger guiding effect. The most appropriate of contact pressure should be determined by practical experiments and adapted to the type of material web and the desired effect.

The invention provides a guiding and braking unit which can be used for its combined function as well as for merely guiding or braking of a moving material web. The unit is built in a compact and simple manner and is particularly economical since it eliminates earlier needs for separate guiding and braking arrangements adapted to different web widths along the path of the material web.

These principles, preferred embodiments and modes of operation of the present invention have been described in the foregoing specification. The invention which is intended to be protected herein should not, however, be construed as limited to the particular forms described, as these are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in the appended claims.

I claim:

1. A guide and braking device for guiding a material web including, a guide cylinder, a rotatable roller and a support arm, said support arm providing said roller with movement in two directions, said web guided between said cylinder and said roller, wherein a first direction of movement is a swivel movement in a plane parallel with a center axis through said cylinder, said first direction of movement swivels said arm about a swivelling axis extending at right angles to the center axis of the cylinder, the swivelling axis and the center axis located on either side of an extension of the cylinder radius, said roller contacting said cylinder through said web within an angle of 2° to 60° from a radius of the cylinder extending perpendicularly to said plane, said roller contacting the cylinder through said web 5° to 15° behind the cylinder radius viewed in the direction of rotation of the cylinder.

2. The device of claim 1, wherein the swivelling axis extends substantially at right angles to an incoming portion of the material web moving toward the guide cylinder.

3. The device of claim 1, wherein the roller is cylindrical.

4. The device of claim 1, wherein the roller consists of a flexible material having a high coefficient of friction.

5. The device of claim 1, wherein the second direction of movement of the roller is between an active position contacting the cylinder through said web and a passive position.

6. The device of claim 1, further including means for generating a compressive force, wherein the roller is pressed against the web and the guide cylinder by said force generating means.

7. The device of claim 6, wherein the roller is moved between active and passive positions by said force generating means.

* * * * *